US009266150B2

(12) United States Patent
Kraft

(10) Patent No.: US 9,266,150 B2
(45) Date of Patent: Feb. 23, 2016

(54) DEVICE AND METHOD FOR REMOVING FINE PARTICLES FROM PARTS

(76) Inventor: Steven J. Kraft, Abilene, KS (US)

( * ) Notice: Subject to any disclaimer, the term of this patent is extended or adjusted under 35 U.S.C. 154(b) by 931 days.

(21) Appl. No.: 13/352,573

(22) Filed: Jan. 18, 2012

(65) Prior Publication Data

US 2012/0180814 A1 Jul. 19, 2012

Related U.S. Application Data

(60) Provisional application No. 61/433,699, filed on Jan. 18, 2011.

(51) Int. Cl.

| | |
|---|---|
| ***B08B 1/04*** | (2006.01) |
| ***A47L 5/38*** | (2006.01) |
| ***A47L 5/22*** | (2006.01) |
| ***B08B 1/00*** | (2006.01) |

(52) U.S. Cl.

CPC ... *B08B 1/04* (2013.01); *A47L 5/22* (2013.01); *A47L 5/38* (2013.01); *B08B 1/006* (2013.01)

(58) Field of Classification Search

CPC ..... A47L 5/22; A47L 5/38; B08B 1/04; B08B 1/006

USPC ..... 15/384, 97.3

See application file for complete search history.

(56) References Cited

U.S. PATENT DOCUMENTS

| | | | | |
|---|---|---|---|---|
| 2,476,537 | A * | 7/1949 | Erickson | 15/383 |
| 3,842,568 | A * | 10/1974 | Spencer | 53/430 |
| 4,426,757 | A * | 1/1984 | Hourticolon et al. | 226/193 |
| 5,127,123 | A * | 7/1992 | Belanger | 15/53.4 |
| 6,035,482 | A * | 3/2000 | Belanger et al. | 15/230.14 |
| 2006/0150352 | A1 * | 7/2006 | Field | 15/98 |
| 2007/0009724 | A1 * | 1/2007 | Bianco et al. | 428/292.1 |
| 2010/0031459 | A1 * | 2/2010 | Holbus | 15/97.3 |

* cited by examiner

*Primary Examiner* — David Redding

(74) *Attorney, Agent, or Firm* — Jeffrey L. Thompson; Thompson & Thompson PA

(57) ABSTRACT

A parts cleaning device has at least one rotor assembly with an axis of rotation, and a plurality of microfiber cloths arranged at spaced locations along a length of each rotor assembly. The microfiber cloths each have an opening through a center portion thereof, and a shaft of the rotor assembly extends through the opening. A plurality of spacers are arranged so that each microfiber cloth is squeezed between two spacers. The rotor assembly is rotated together with the microfiber cloths so that centrifugal forces cause the microfiber cloths to extend radially outwardly from the rotor assembly and wipe surfaces of parts that pass within a path of movement of the microfiber cloths. A vacuum chamber has an inlet positioned in the path of movement of the cloths for removing fine particles from the cloths as the cloths rotate past the inlet.

18 Claims, 13 Drawing Sheets

DEVICE AND METHOD FOR REMOVING FINE PARTICLES FROM PARTS

RELATED APPLICATIONS

This application claims priority of U.S. Provisional Application No. 61/433,699 filed on Jan. 18, 2011. The entire contents of this prior application are incorporated herein by reference.

BACKGROUND OF THE INVENTION

1. Field of the Invention

The present invention relates generally to devices and methods for removing fine particles from parts during a manufacturing process, and in particular, to devices and methods for wiping fine particles from a surface of a part.

2. Description of the Related Art

Processes for manufacturing cabinets, furniture and other wood products typically include a series of smoothing and finishing steps. For example, at least one and often several sanding and buffing steps are typically used to smooth and prepare a wood surface to receive sealants, stains, varnishes, and other surface coatings. Additional sanding or buffing steps are also typically used between surface coatings to prepare the surface for each new coating.

Sanding and buffing creates fine particles that must be removed from the wood surface or coated surface before a finish coating is applied to the surface. This is typically accomplished by manually wiping the part using tack rags, cheese cloth, or the like. However, such manual wiping is labor intensive and often creates a bottleneck that limits the efficiency of a manufacturing process.

A power driven duster using ostrich feathers has been used to remove dust from wood surfaces. However, the ostrich feathers of the duster were expensive and relatively fragile, requiring frequent maintenance and high operating costs.

There is a need in the industry for an improved device and method for removing fine particles from wood surfaces and other parts during a manufacturing process.

SUMMARY OF THE INVENTION

An object of the present invention is to provide a parts cleaning device that can be used to remove fine particles, such as dust, from manufactured products.

A further object of the present invention is to provide a parts cleaning device that is capable of removing fine particles from parts that are conveyed past the cleaning device during a manufacturing process.

A further object of the present invention is to provide a parts cleaning device and method that reduces or eliminates manual wiping of parts and increases the efficiency of a manufacturing process.

A further object of the present invention is to provide a parts cleaning device that is durable and self-cleaning to allow it to be operated continuously for long periods of time.

A still further object of the present invention is to provide a parts cleaning device that is simple in construction, efficient in operation, useful in a variety of applications, inexpensive to manufacture, and capable of a long operating life.

To achieve these and other objects of the present invention, a parts cleaning device is provided having at least one rotor assembly with an axis of rotation, and a plurality of microfiber cloths arranged at spaced locations along a length of the rotor assembly. The microfiber cloths each have an opening through a center portion thereof, and a shaft of the rotor assembly extends through the opening. A plurality of spacers are assembled onto the rotor assembly and arranged so that each microfiber cloth is squeezed between two spacers to cause the microfiber cloths to rotate together with the rotor assembly. The rotor assembly is rotated together with the microfiber cloths so that centrifugal forces cause the microfiber cloths to extend radially outwardly from the rotor assembly and wipe surfaces of parts that pass within a path of movement of the microfiber cloths. A vacuum chamber has an inlet positioned in the path of movement of the cloths for removing fine particles from the cloths as the cloths rotate past the inlet.

According to one aspect of the present invention, a parts cleaning device is provided, comprising: a first rotor assembly having a first axis of rotation; at least one microfiber cloth arranged to rotate with the first rotor assembly; and a means for rotating the first rotor assembly together with the microfiber cloth about the first axis so that centrifugal forces cause the microfiber cloth to extend radially outwardly from the first rotor assembly for wiping a surface of a part to be cleaned.

According to another aspect of the present invention, a method of cleaning parts is provided, comprising: a providing a first rotor assembly having a first axis of rotation; providing a plurality of microfiber cloths along the first rotor assembly; and rotating the first rotor assembly about the first axis so that centrifugal forces cause the microfiber cloths to extend radially outwardly from the first rotor assembly for wiping a first surface of a part to be cleaned.

Numerous other objects of the present invention will be apparent to those skilled in this art from the following description wherein there is shown and described embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A parts cleaning device 10 according to the present invention is described in detail herein with reference to FIGS. 1 to 18 of the accompanying drawings.

Figure 2:
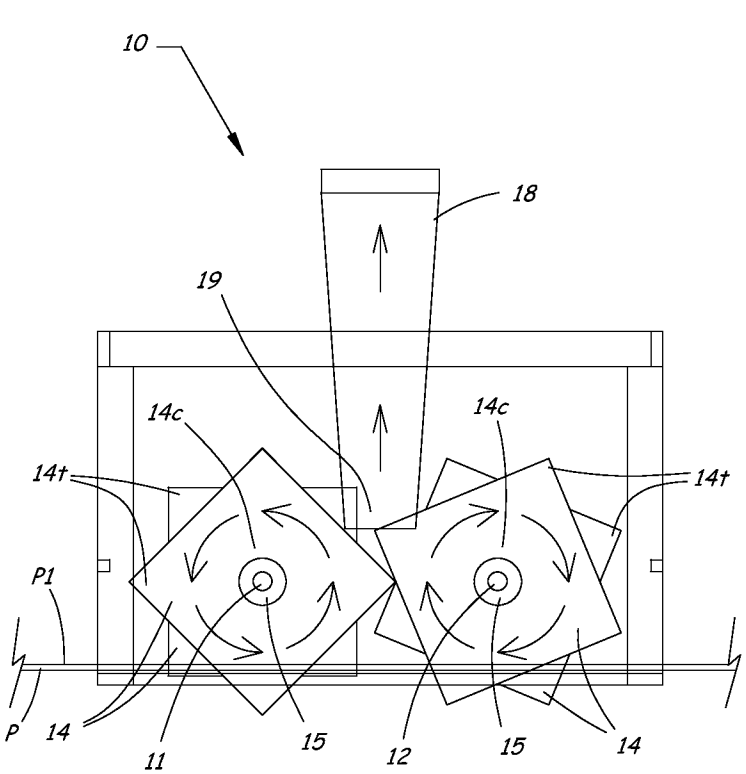
FIG. 2 is a cross section end view of the parts cleaning device shown in FIG. 1.
Figure 1:
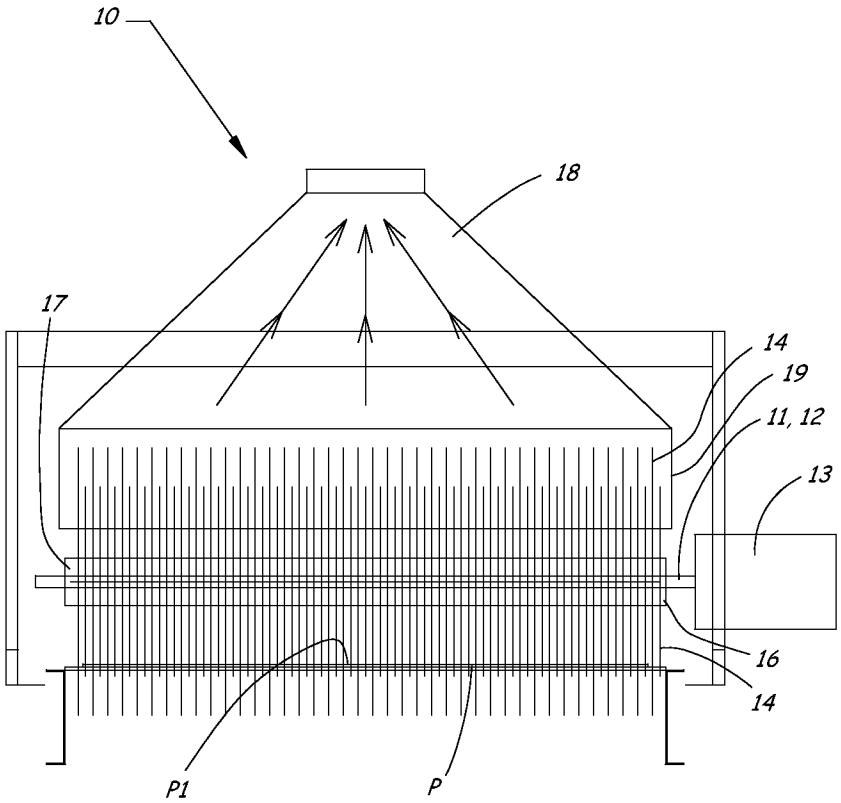
FIG. 1 is a front view of a parts cleaning device arranged in a horizontal configuration for a flat conveyor line according to the present invention.
Figure 3:
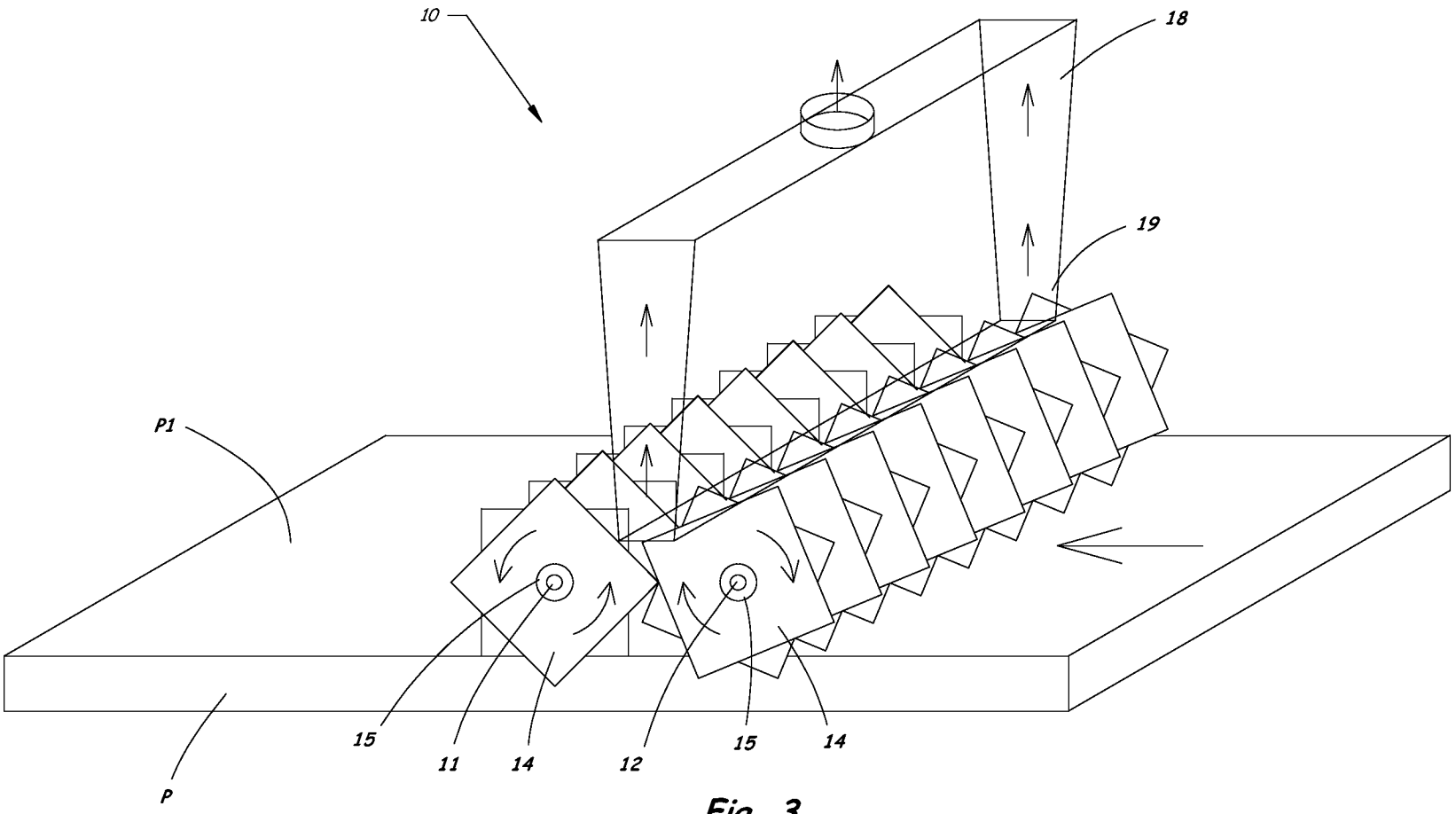
FIG. 3 is a perspective view of a parts cleaning device of the present invention, with two rotor assemblies arranged side-by-side in a horizontal configuration for a flat conveyor line.

The parts cleaning device 10 shown in FIGS. 1 to 3 includes first and second rotor assemblies 11, 12 having first and second parallel axes of rotation, respectively. The rotor assemblies 11, 12 are each connected to a drive means, such as an electrical or hydraulic motor 13, for rotating the rotor assemblies 11, 12 about the respective first and second axes. For example, the drive means 13 can be used to rotate the rotor assemblies 11, 12 at a speed of approximately 60 to 150 rpm, and preferably about 100 to 120 rpm, depending on the particular application. For example, a slower rotation speed can be more effective for wiping detailed moldings and the like, while a faster speed may be better suited for cleaning relatively smooth parts. The drive means 13 can also include a belt and pulley assembly and/or a chain and sprocket assembly (not shown) connected between the motor(s) and the rotor assemblies 11, 12. The rotation speed can be changed to suit a particular application.

A plurality of microfiber cloths 14 are arranged at spaced locations along a length of each of the rotor assemblies 11, 12. As used herein, the term "microfiber" refers to synthetic fibers that measure less than one denier, which are commonly made from polyesters, polyamides, and/or a conjugation of polyester and polyamide. For example, suitable microfiber cloths for use in the present invention are marketed by Saint-Gobain Abrasives, Inc. of Stephenville, Tex. under the proprietary name Norton Micro-Fiber Dry Tack Cloth (Red), and by Newell Rubbermaid Inc. of Atlanta, Ga. under the proprietary name Rubbermaid Red Microfiber Cleaning Cloth (Product No. Q62022 Red).

The microfiber cloths 14 each have an opening through a center portion 14*c* thereof, and a shaft of the rotor assemblies 11, 12 extends through the openings. A plurality of spacers 15 are assembled onto the shaft of each of the rotor assemblies 11, 12 and are arranged so that each spacer 15 is located between each adjacent pair of microfiber cloths 14. A clamping hub 16, 17 or other suitable structure is provided at each end of the rotor assemblies 11, 12 to keep the assembly of cloths 14 and spacers 15 together on the rotor assembly 11, 12. Each microfiber cloth 14 is squeezed between two spacers 15 (or an end structure 16, 17 and a spacer 15) to cause the microfiber cloths 14 to rotate together with the rotor assemblies 11, 12. For example, the spacers 15 can be sleeve members having an internal diameter slightly larger than a diameter of the shafts of the rotor assemblies 11, 12, an outer diameter larger than the center openings in the microfiber cloths 14, and a length of approximately one inch. In this example, the microfiber cloths 14 would be spaced approximately one inch apart along the length of the rotor assemblies 11, 12. Other spacings can be achieved to suit a particular application by varying the number and/or the length of the spacers 15.

The drive motor 13 operates to rotate the rotor assemblies 11, 12 together with the microfiber cloths 14 at a speed at which centrifugal forces cause the microfiber cloths 14 to extend radially outwardly from the rotor assembly 11, 12 on which the cloths 14 are mounted. When the microfiber cloths 14 are radially extended, they generally each lie in a respective plane perpendicular to the axis of the rotor assembly 11, 12 on which they are mounted. As the rotor assemblies 11, 12 and microfiber cloths 14 rotate, the microfiber cloths 14 can be used to wipe a surface of a part P that passes within a path of movement of the cloths 14.

A vacuum chamber 18 has an inlet 19 positioned between and slightly above the rotor assemblies 11, 12. The vacuum chamber 18 functions to remove fine particles from the cloths 14 as the cloths 14 rotate past the inlet 19. The inlet 19 is preferably positioned in a path of movement of the outer tips 14*t* of the cloths 14 so that the cloths 14 impinge on the inlet 19 to help loosen particles from the cloths 14, which are then sucked up into the vacuum chamber 18.

The microfiber cloths 14 preferably have a noncircular shape. For example, the cloths 14 can be square or rectangular, as shown in FIGS. 2 and 3. With a noncircular shape, the cloths 14 have corners 14*t* that provide a more effective cleaning action on parts having surface detail, such as decorative moldings and cabinet panels. The corners 14*t* of the cloths 14 are better able to pass into depressions and other surface irregularities of the parts, thereby improving the wiping and cleaning action. In one example, microfiber cloths 14 having a rectangular shape with sides of approximately 12 to 24 inches long can be used.

The first and second rotor assemblies 11, 12 shown in FIGS. 1 to 3 are arranged in a substantially horizontal configuration for use with a flat conveyor line. The parts P to be cleaned are conveyed along the flat conveyor line under the rotating cloths 14, which wipe across the top surface P1 of the parts P. The vacuum chamber 18 is substantially centered over and between the first and second rotor assemblies 11, 12. The first and second rotor assemblies 11, 12 rotate in opposite directions relative to each other, as shown by arrows in FIGS. 2 and 3, so that the particles removed from the parts P being cleaned are moved upwardly by the cloths 14 between the two rotor assemblies 11, 12 and into the vacuum chamber inlet 19.

Figure 4:
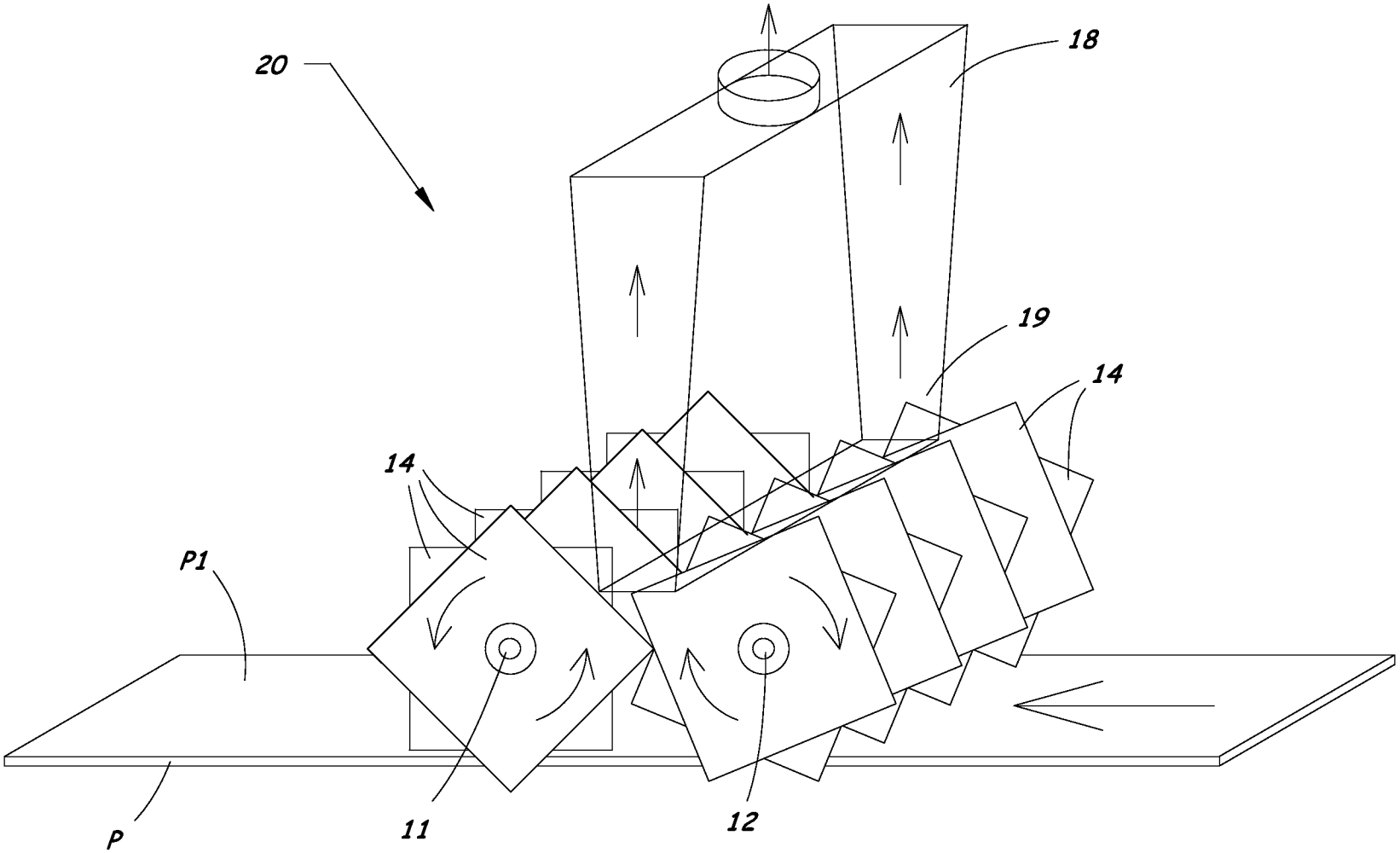
FIG. 4 is a perspective view of a parts cleaning device similar to FIG. 3, with a narrow configuration for cleaning narrow parts, such as trim molding.

FIG. 4 illustrates a parts cleaning device 20 similar to FIG. 3, with a narrower configuration for cleaning narrow parts, such as trim molding and the like. For the sake of brevity, the same reference numerals are used in FIG. 4 to designate the elements of device 20 that correspond with the elements of device 10 described above.

Figure 5:
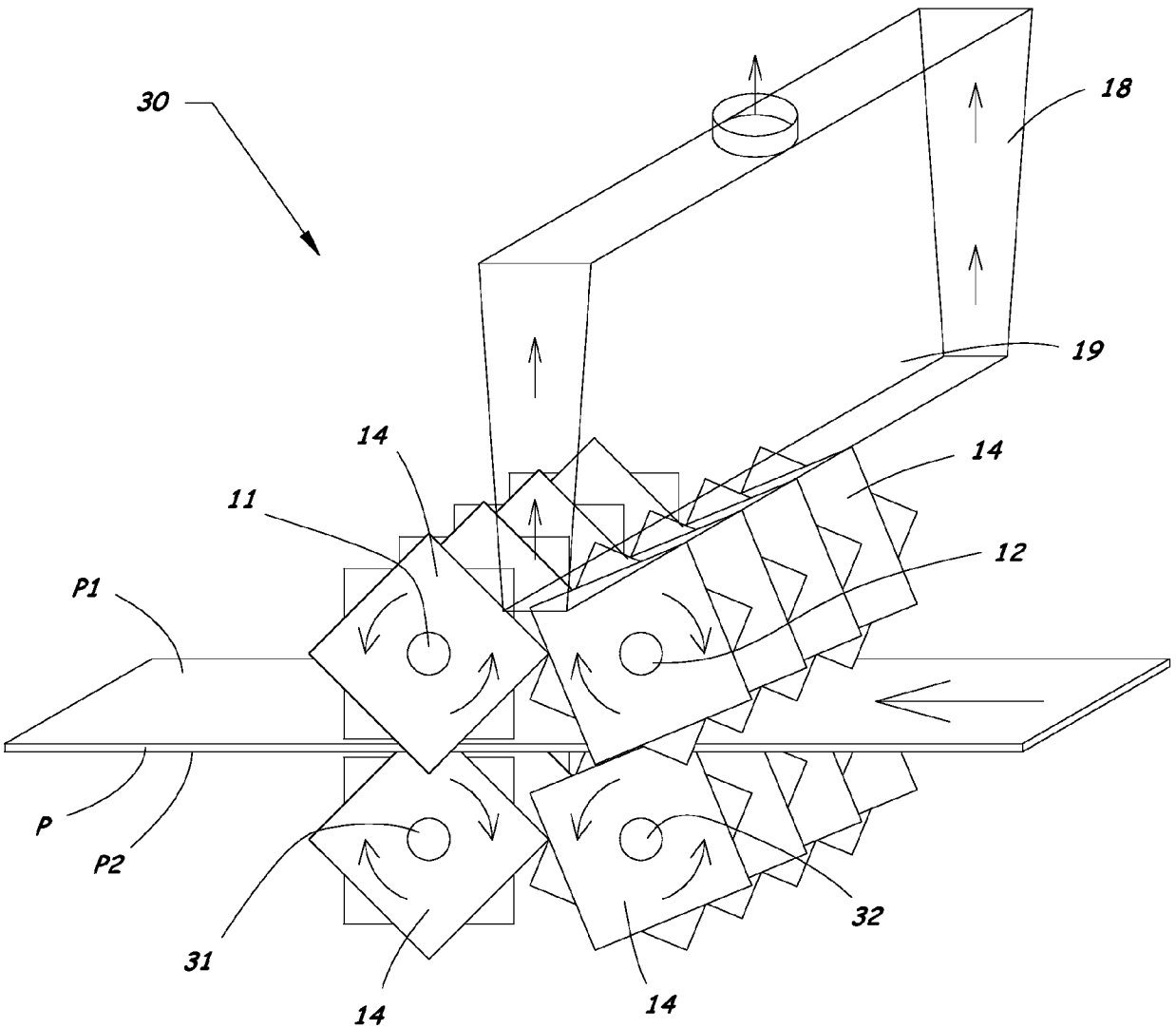
FIG. 5 is a perspective view of a parts cleaning device of the present invention, with four rotor assemblies arranged in a horizontal configuration for cleaning both top and bottom surfaces of a part carried by a flat conveyor line.

FIG. 5 illustrates a parts cleaning device 30 having third and fourth rotor assemblies 31, 32 located below the part P to be cleaned. For the sake of brevity, the same reference numerals are used in FIG. 5 to designate the elements of device 30 that correspond with the elements of device 10 described above.

The third and fourth rotor assemblies 31, 32 have third and fourth axes of rotation, respectively, and are arranged parallel with the first and second rotor assemblies 11, 12. A plurality of microfiber cloths 14 are arranged at spaced locations along each of the third and fourth rotor assemblies 31, 32, similar to the first and second rotor assembly assemblies 11, 12. In this embodiment, the third and fourth rotor assemblies 31, 32 are arranged below the first and second rotor assemblies 11, 12 so that the part to be cleaned can be passed under the first and second rotor assemblies 11, 12 and over the third and fourth rotor assemblies 31, 32 to have a top surface P1 and a bottom surface P2 of the part P wiped simultaneously by the microfiber cloths 14.

Figure 6:
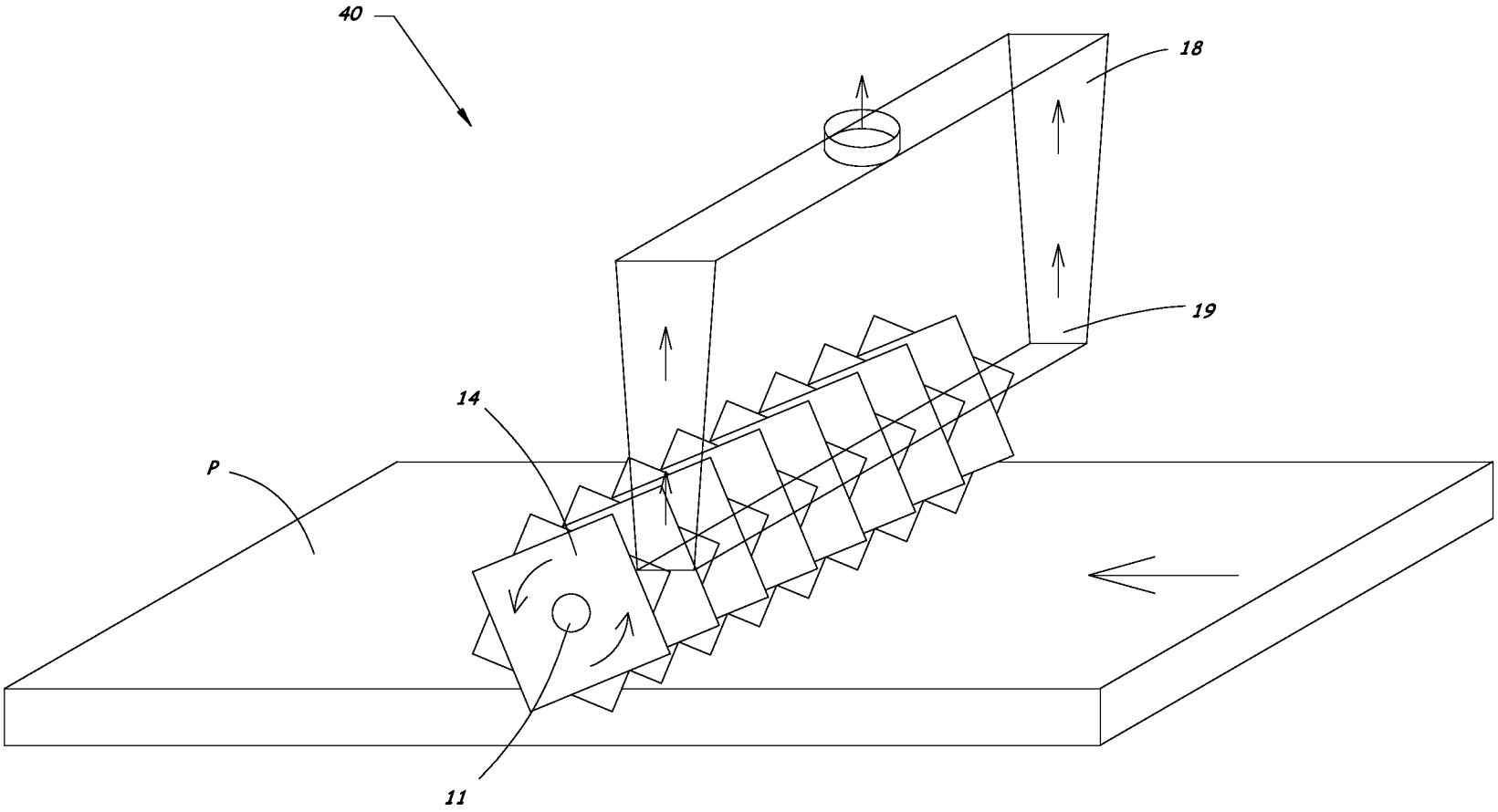
FIG. 6 is a perspective view of a parts cleaning device of the present invention, with a single rotor assembly arranged in a horizontal configuration for a flat conveyor line.
Figure 7:
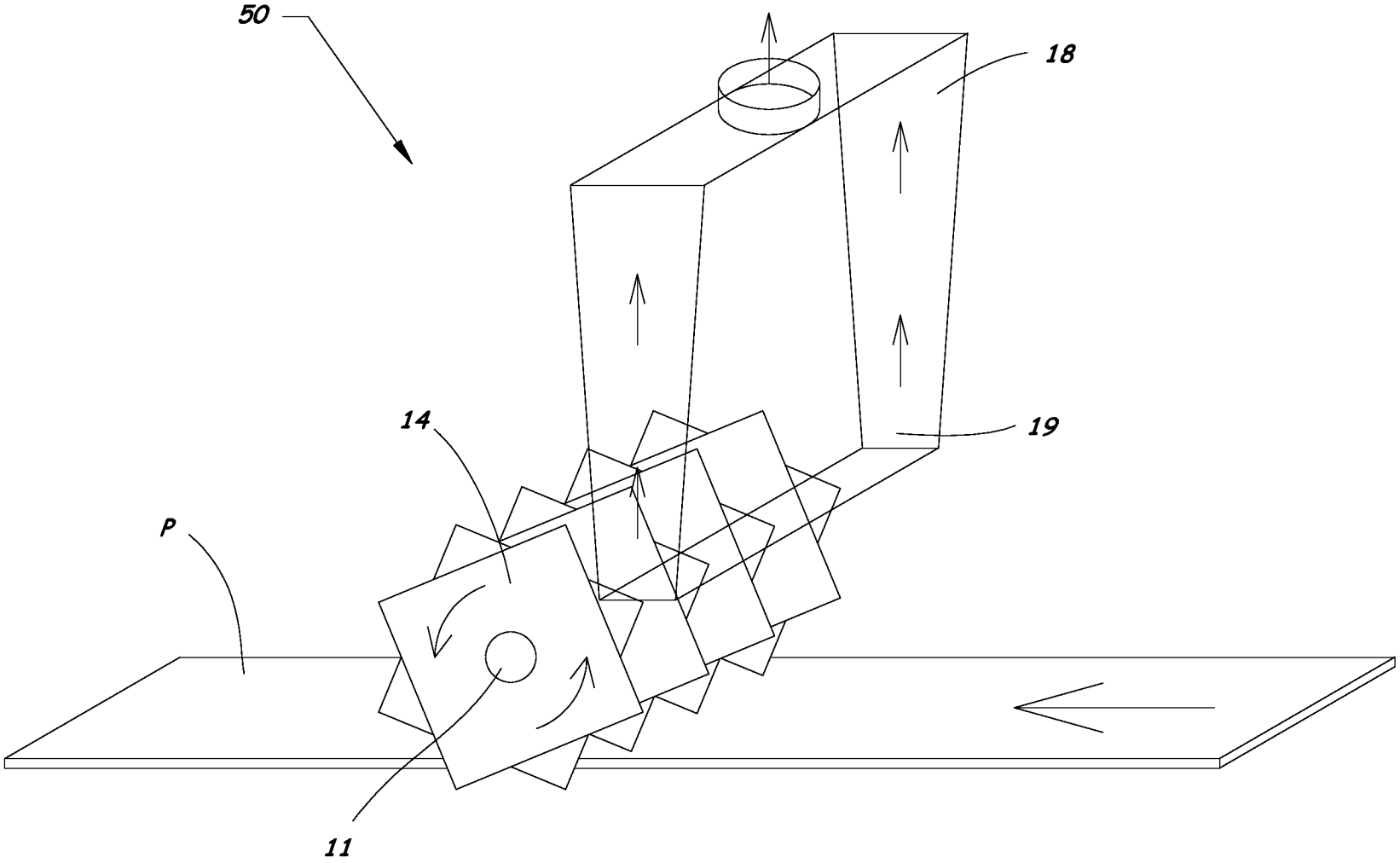
FIG. 7 is a perspective view of a parts cleaning device of the present invention, with a single rotor assembly and a narrow configuration for cleaning narrow parts.
Figure 8:
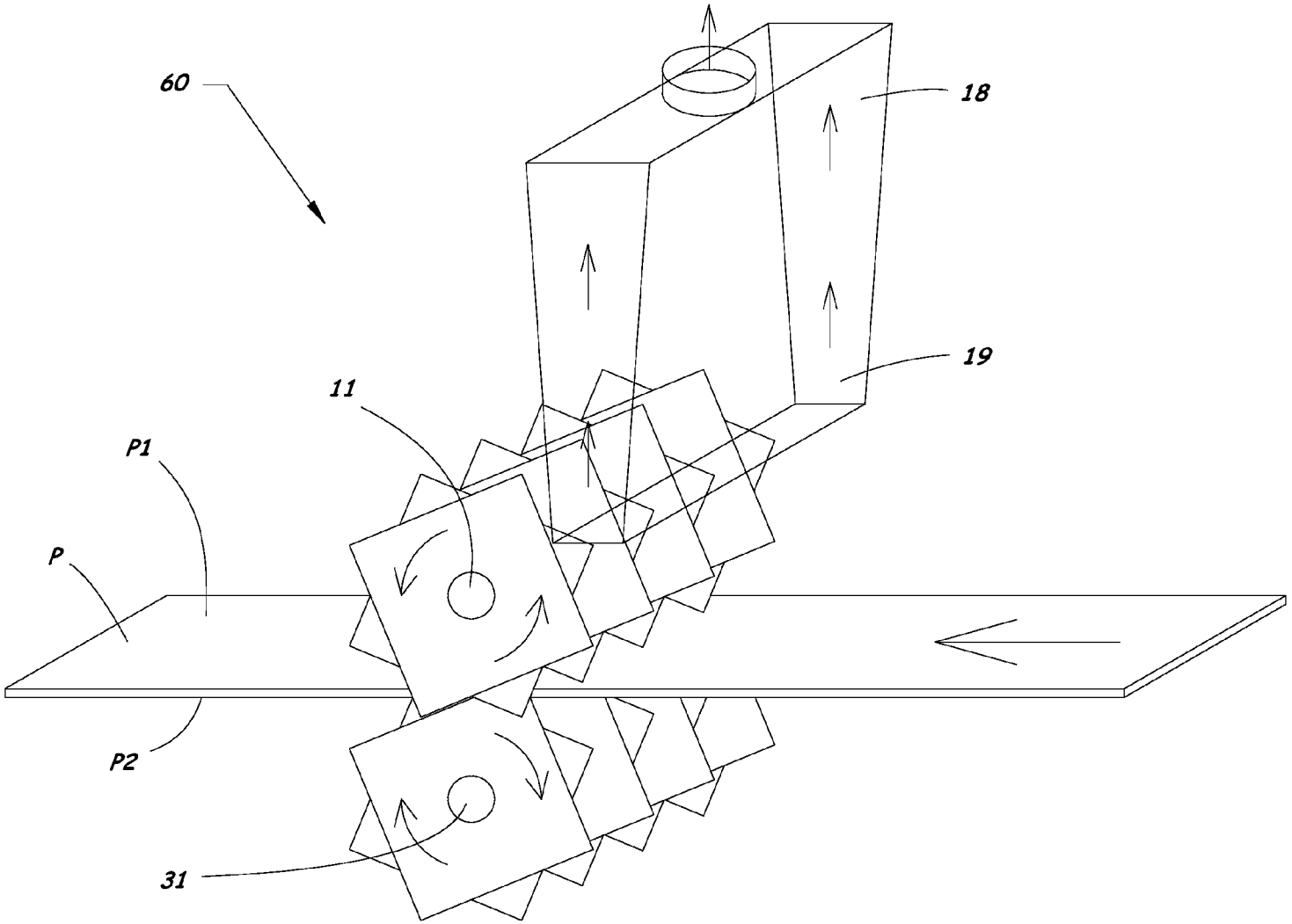
FIG. 8 is a perspective view of a parts cleaning device of the present invention, with two rotor assemblies arranged one above the other for cleaning both top and bottom surfaces of a part carried by a flat conveyor line.

FIGS. 6 to 8 illustrate parts cleaning devices according to alternative embodiments of the present invention. The embodiment 40 shown in FIG. 6 is similar to FIG. 3, except that a single rotor assembly 11 is used instead of two rotor assemblies 11, 12. The embodiment 50 shown in FIG. 7 is similar to FIG. 6, except that the single rotor assembly 11 has a narrower configuration for cleaning narrow parts. The embodiment 60 shown in FIG. 8 is similar to FIG. 5, except that only one rotor assembly 11 is provided to clean the top surface P1 of a part P, and only one rotor assembly 31 is provided to clean the bottom surface P2 of the part P.

FIGS. 9 to 14 illustrate a parts cleaning device 70 having an adjustable support stand 71 for supporting the rotor assemblies 11, 12 relative to a part P to be cleaned. The support stand 71 includes a base 72 supported by a plurality of wheels 73, an upright member 74 extending above the base 72, and an arm 75 pivotally attached to the upright member 74. The rotor assemblies 11, 12 are connected to and supported by the arm 75.

Figure 10:
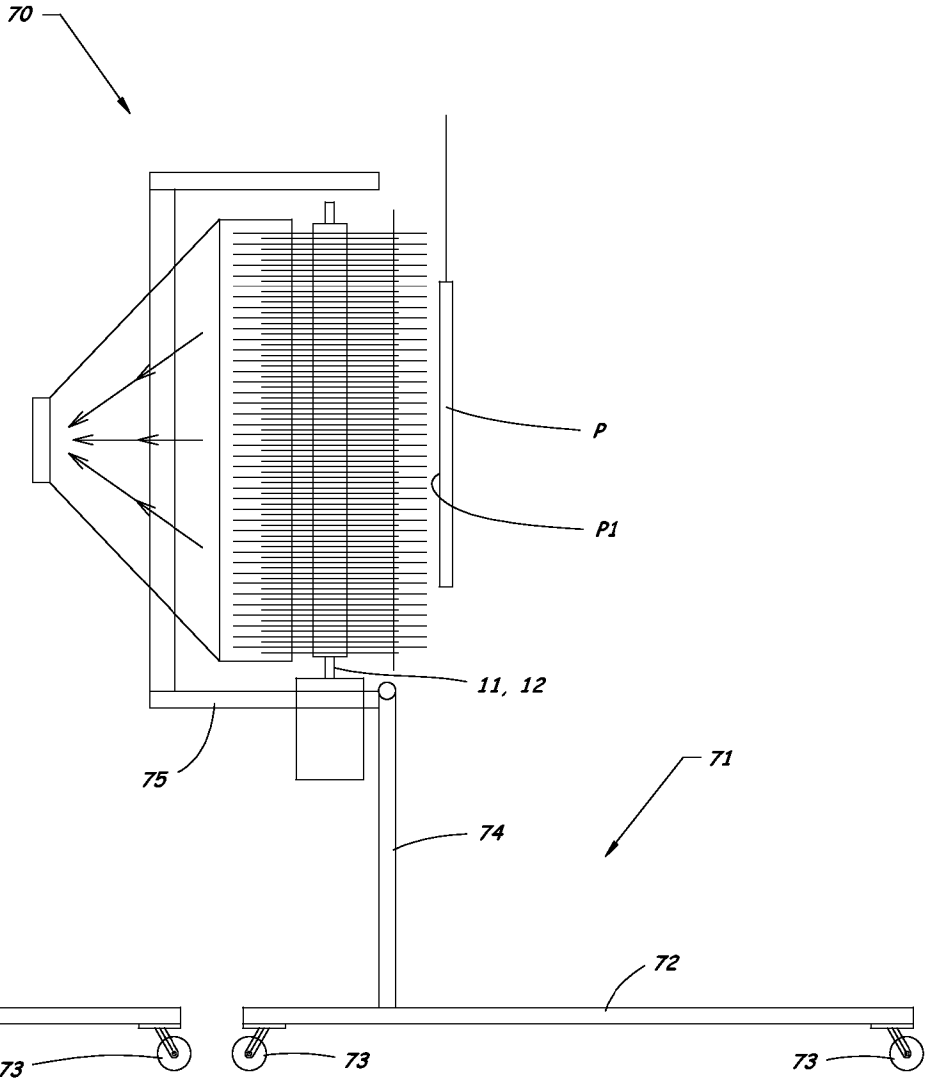
FIG. 10 is a front view of the parts cleaning device shown in FIG. 9, with the support stand adjusted to provide a different rotor assembly height.
Figure 9:
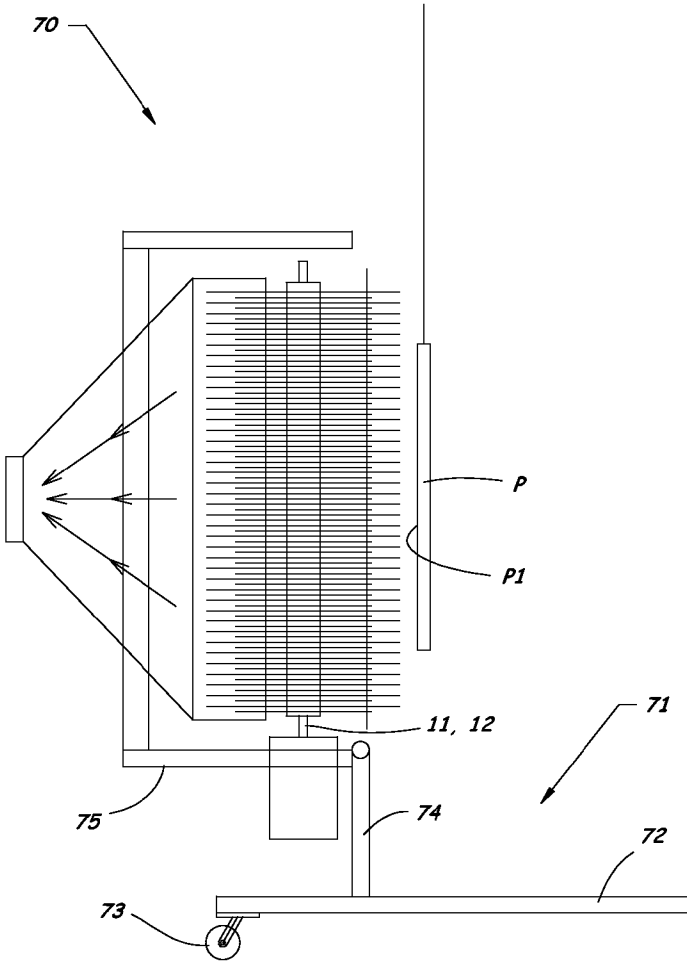
FIG. 9 is a front view of a parts cleaning device having an adjustable support stand arranged with the rotor assembly in a vertical orientation.
Figure 11:
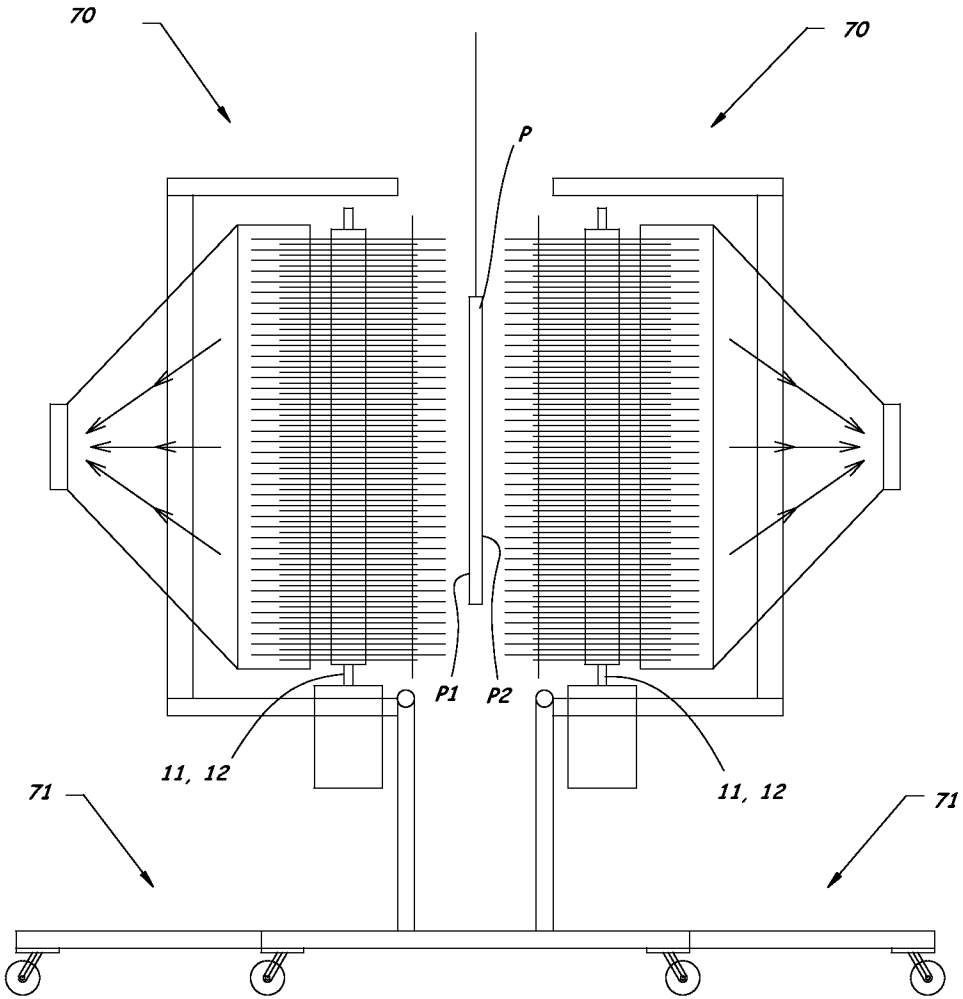
FIG. 11 is a front view of a pair of parts cleaning devices of the present invention arranged to simultaneously clean two sides of parts supported by a hanging conveyor line.
Figure 13:
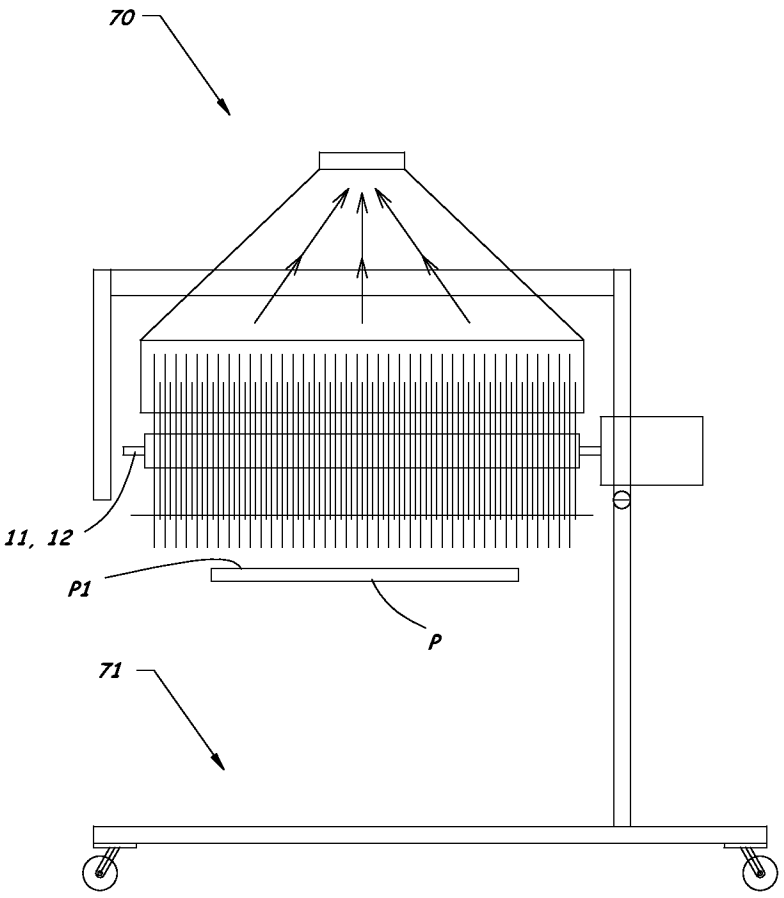
FIG. 13 is a front view of the parts cleaning device shown in FIG. 12, with the support stand adjusted to provide a different rotor assembly height.
Figure 12:
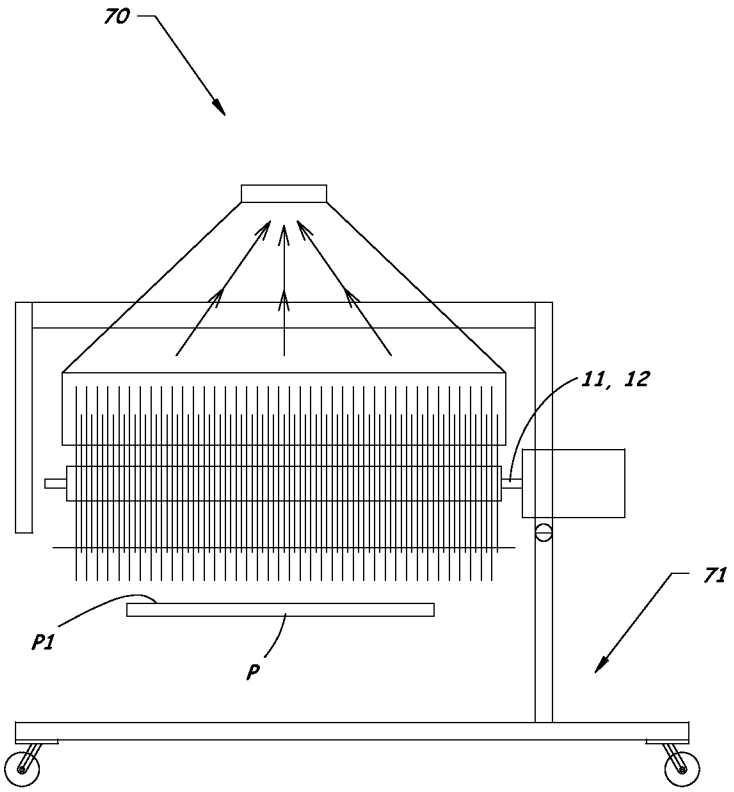
FIG. 12 is a front view of the parts cleaning device shown in FIG. 9, with the support stand adjusted to a different angular position with the rotor assembly in a horizontal orientation.

The arm 75 is angularly adjustable about its pivotal attachment to the upright member 74 to allow the rotor assembly 11, 12 to be moved between a first angular position in which the axis of the rotor assembly 11, 12 is substantially vertical (FIGS. 9 and 10), and a second angular position in which the axis of the rotor assembly 11, 12 is substantially horizontal (FIGS. 12 and 13). The upright member 74 is extendable so that the arm 75 can be vertically adjusted relative to the base member 72 to adjust a height of the rotor assembly 11, 12. In FIGS. 9 and 10, the rotor assembly 11, 12 is supported by the support stand 71 in a vertical orientation for cleaning parts P supported by a hanging conveyor line. FIG. 11 illustrates a pair of parts cleaning devices 70 supported by respective support stands 71 for simultaneously cleaning two sides P1, P2 of parts P supported by a hanging conveyor line.

In FIGS. 12 and 13, the rotor assembly 11, 12 is supported by the support stand 71 in a horizontal orientation at two different heights for cleaning parts P supported by a flat conveyor line.

Figure 15:
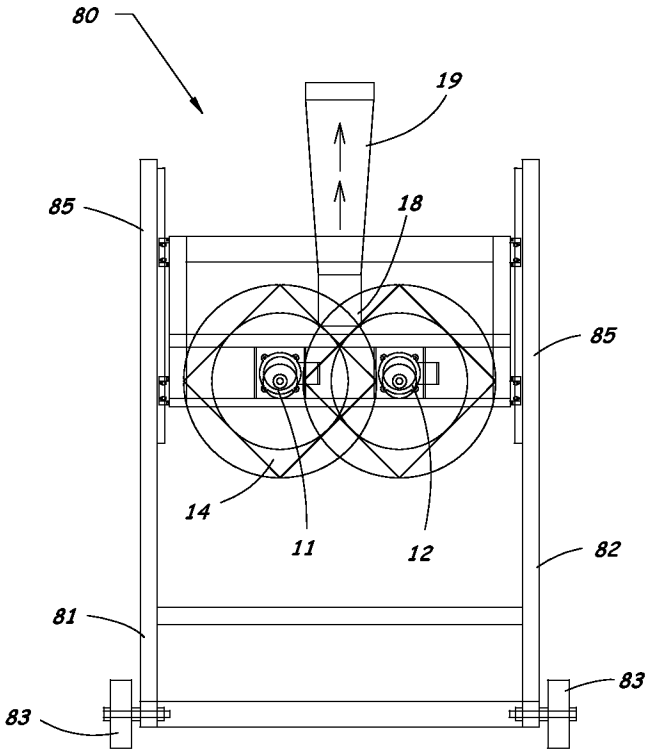
FIG. 15 is a side elevation view of the parts cleaning device shown in FIG. 14.
Figure 14:
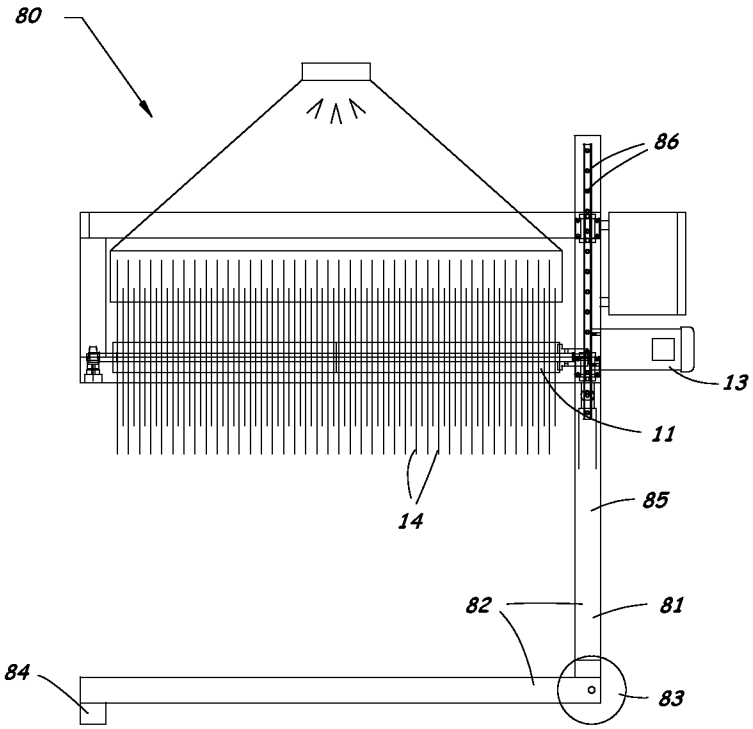
FIG. 14 is a front elevation view of a parts cleaning device for a horizontal conveyor line having a mobile support stand and a height adjustment mechanism.

FIGS. 14 and 15 show a parts cleaning device 80 for a horizontal conveyor line according to another embodiment of the invention. The parts cleaning device 80 includes a mobile support stand 81 having a frame 82 supported by a pair of wheels 83 at one end and a stabilizing foot 84 at another end. The support stand 81 allows the device 80 to be easily maneuvered to a desired position along a conveyor line. The support stand 81 also includes a pair of upright masts 85 located on each side of the frame 82. A plurality of mounting holes 86 are provided along a length of each upright mast 85 for providing a plurality of vertical positions for the rotor assemblies 11, 12. For the sake of brevity, the same reference numerals are used in FIGS. 14 and 15 to designate the elements of device 80 that correspond with the elements of device 10 described above.

Figure 16:
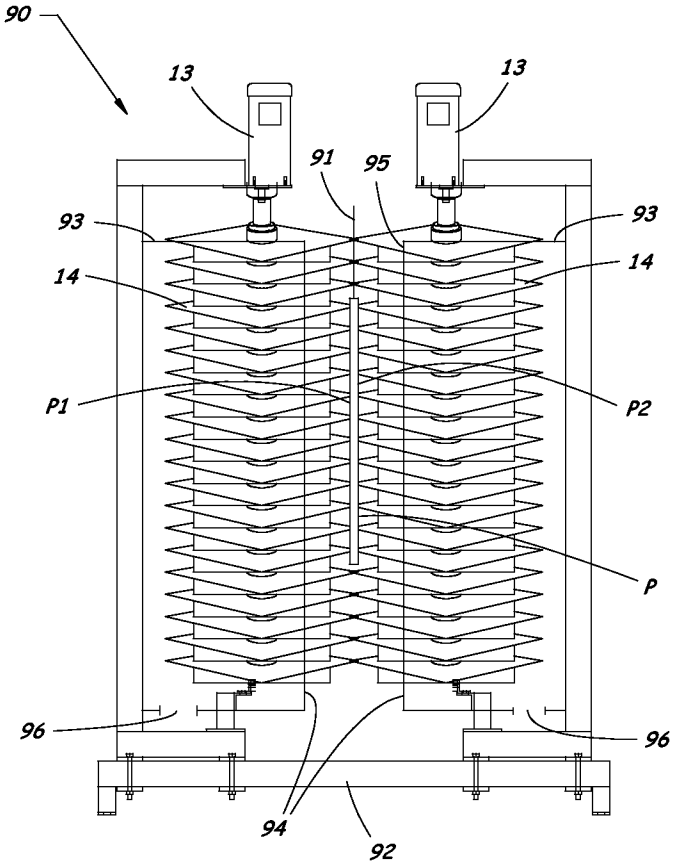
FIG. 16 is a perspective front elevation view of a parts cleaning device for a hanging conveyor line having rotor assemblies arranged to clean two sides of the hanging parts.
Figure 18:
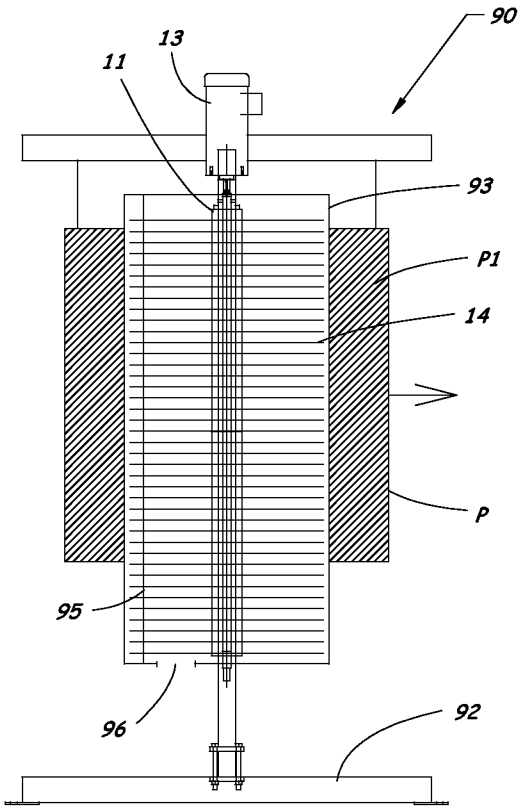
FIG. 18 is a side elevation view of the parts cleaning device shown in FIG. 16.
Figure 17:
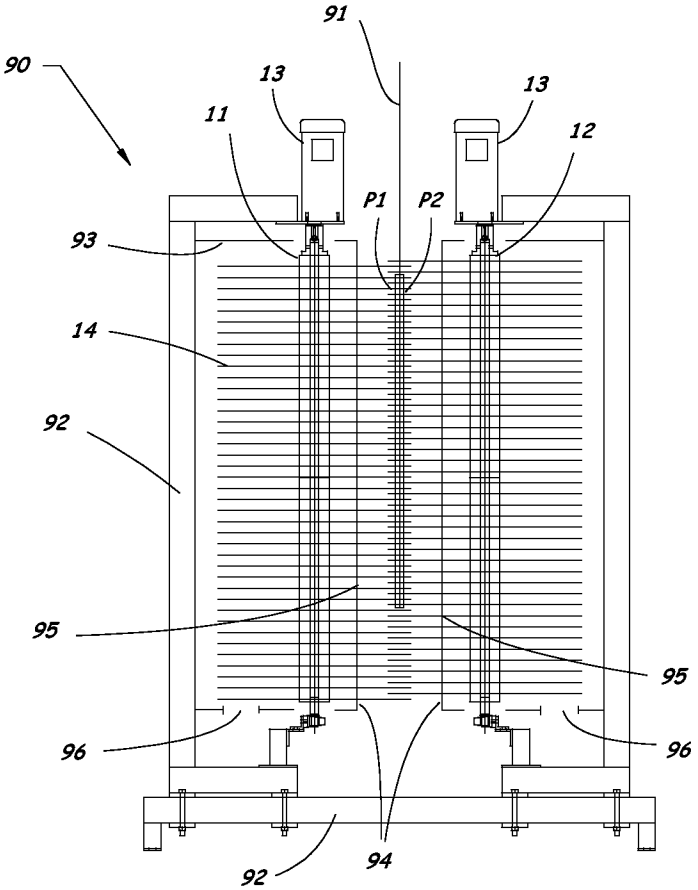
FIG. 17 is a front elevation view of the parts cleaning device shown in FIG. 16.

FIGS. 16 to 18 show a parts cleaning device 90 for a hanging conveyor line 91 according to another embodiment of the invention. The parts cleaning device 90 includes a frame 92 that supports first and second rotor assemblies 11, 12 for rotation on opposite sides P1, P2 of the parts P being conveyed along the hanging conveyor line 91.

A box 93 is formed around three sides of each of the rotor assemblies 11, 12, with an open side 94 of the box 93 facing the parts P being cleaned. The box 93 functions as a safety guard for the moving parts of the machine, and also as a dust extraction chamber. The microfiber cloths 14 extend radially outwardly from the rotor assemblies 11, 12 past the edge of the box 93 during operation to contact the surfaces of the parts P.

An inpingement divider 95 is provided within the box 93 or along an edge of the box 93 to engage the microfiber cloths 14 and dislodge dust and other particles from the cloths 14 during operation. A dust extraction port 96 on the box 93 is connected to a central vacuum system for vacuuming dust and other particles away from the microfiber cloths 14 and out of the box 93. The dust extraction port 96 can be provided, for example, on the bottom of the box 93 so that gravitational forces will aid in conveying dust and other particles toward the port 96 for more efficient removal. For the sake of brevity, the same reference numerals are used in FIGS. 16 to 18 to designate the elements of device 90 that correspond with the elements of device 10 described above.

The parts cleaning devices 10-90 described in this application have several possible uses. For example, the devices can be used to remove fine particles from wood products, such as cabinets and furniture, during manufacturing. For another example, the devices can be used to remove trimming dust and particles from corrugated cardboard after the cardboard is cut. For another example, the devices can be used to remove wax and/or polishing compound haze from surfaces. For still another example, the devices can be used to wipe staining compounds from wood products, such as cabinets and furniture, during finishing operations. Other uses of the devices may become apparent to those skilled in the art.

While the invention has been specifically described in connection with specific embodiments thereof, it is to be understood that this is by way of illustration and not of limitation, and the scope of the appended claims should be construed as broadly as the prior art will permit.

What is claimed is:

1. A parts cleaning device, comprising:

a first rotor assembly having a first axis of rotation;

at least one microfiber cloth arranged to rotate with said first rotor assembly; and a means for rotating said first rotor assembly together with said microfiber cloth about said first axis so that centrifugal forces cause said microfiber cloth to extend radially outwardly from said first rotor assembly for wiping fine particles from a surface of a part to be cleaned;

further comprising a vacuum chamber having an inlet positioned in a path of movement of said microfiber cloth, said vacuum chamber providing a means for removing fine particles from said microfiber cloth as the cloth rotates past and impinges on said vacuum chamber.

2. The parts cleaning device according to claim 1, wherein said microfiber cloth is generally rectangular in shape with an opening through a center portion thereof, and a shaft of said first rotor assembly extends through said opening of each microfiber cloth.

3. The parts cleaning device according to claim 1, wherein said at least one microfiber cloth comprises a plurality of microfiber cloths arranged at spaced locations along said first rotor assembly.

4. The parts cleaning device according to claim 3, wherein each of said microfiber cloths has an opening through a center portion thereof, and a shaft of said first rotor assembly extends through said opening of each microfiber cloth.

5. The parts cleaning device according to claim 4, further comprising a plurality of spacers assembled onto the shaft of said first rotor assembly and arranged so that one of said spacers is located between each adjacent pair of said microfiber cloths.

6. The parts cleaning device according to claim 5, wherein the center portion of each of said microfiber cloths is squeezed between two of said spacers to cause said microfiber cloths to rotate together with said first rotor assembly.

7. The parts cleaning device according to claim 1, wherein said microfiber cloth has a noncircular shape.

8. The parts cleaning device according to claim 1, wherein said first rotor assembly is positioned for use with a flat conveyor line, and said first axis of rotation is substantially horizontal.

9. The parts cleaning device according to claim 1, wherein said first rotor assembly is positioned for use with a hanging conveyor line, and said first axis of rotation is substantially vertical.

10. The parts cleaning device according to claim 1, further comprising a second rotor assembly having a second axis of rotation, said second rotor assembly being arranged parallel to said first rotor assembly and transverse to a direction of movement of the part to be cleaned, and said at least one microfiber cloth comprises a plurality of microfiber cloths arranged at spaced locations along each of said first and second rotor assemblies.

11. The parts cleaning device according to claim 10, wherein said vacuum chamber inlet is positioned in a path of movement of the microfiber cloths arranged on said second rotor assembly.

12. The parts cleaning device according to claim 11, wherein said means for rotating said first rotor assembly comprises a means for rotating said first and second rotor assemblies in opposite directions relative to each other about said first and second axes, respectively.

13. A parts cleaning device, comprising:

a first rotor assembly having a first axis of rotation;

at least one microfiber cloth arranged to rotate with said first rotor assembly; and a means for rotating said first rotor assembly together with said microfiber cloth about said first axis so that centrifugal forces cause said microfiber cloth to extend radially outwardly from said first rotor assembly for wiping a surface of a part to be cleaned;

further comprising a second rotor assembly having a second axis of rotation, said second rotor assembly being arranged parallel to said first rotor assembly, and said at least one microfiber cloth comprises a plurality of microfiber cloths arranged at spaced locations along each of said first and second rotor assemblies;

further comprising a vacuum chamber having an inlet positioned in a path of movement of the microfiber cloths arranged on each of said first and second rotor assemblies, said vacuum chamber providing a means for removing fine particles from said microfiber cloths as the cloths rotate past and impinge on said vacuum chamber;

wherein said first and second rotor assemblies are arranged side-by-side in a substantially horizontal configuration for use with a flat conveyor line, and wherein said vacuum chamber is substantially centered over said first and second rotor assemblies.

14. The parts cleaning device according to claim 13, further comprising third and fourth rotor assemblies having third and fourth axes of rotation, respectively, said third and fourth rotor assemblies being arranged parallel to said first and second rotor assemblies, and said at least one microfiber cloth further comprises a plurality of microfiber cloths arranged at spaced locations along each of said third and fourth rotor assemblies, wherein said third and fourth rotor assemblies are arranged so that a part to be cleaned can be passed between said first and second rotor assemblies and said third and fourth rotor assemblies to have two surfaces of the part wiped simultaneously by the microfiber cloths.

15. The parts cleaning device according to claim 10, wherein said first and second rotor assemblies are arranged so that a part to be cleaned can be passed between said first and second rotor assemblies and have first and second surfaces of the part wiped simultaneously by the microfiber cloths on the first and second rotor assemblies, respectively.

16. A parts cleaning device, comprising:

a first rotor assembly having a first axis of rotation;

at least one microfiber cloth arranged to rotate with said first rotor assembly; and a means for rotating said first rotor assembly together with said microfiber cloth about said first axis so that centrifugal forces cause said microfiber cloth to extend radially outwardly from said first rotor assembly for wiping a surface of a part to be cleaned;

further comprising an adjustable support stand for supporting said rotor assembly relative to a part to be cleaned, said support stand comprising a base supported by wheels, an upright member extending above said base, and an arm pivotally attached to said upright member, said rotor assembly being connected to and supported by said arm.

17. The parts cleaning device according to claim 16, wherein said arm is angularly adjustable relative to said base member to allow said rotor assembly to be moved between a first angular position in which said axis is substantially vertical and a second angular position in which said axis is substantially horizontal.

18. The parts cleaning device according to claim 17, wherein said arm is vertically adjustable relative to said base member to adjust a height of said rotor assembly.

* * * * *